United States Patent [19]

Lankard

[11] Patent Number: 4,668,548

[45] Date of Patent: May 26, 1987

[54] INTEGRALLY-ANCHORED FIBER-REINFORCED CONCRETE OVERLAYS AND SURFACINGS AND METHOD OF MAKING SAME

[75] Inventor: David R. Lankard, Columbus, Ohio

[73] Assignees: Ribbon Technology Court, Gahanna; Lankard Materials Laboratory Inc., Columbus, both of Ohio ; a part interest

[21] Appl. No.: 815,341

[22] Filed: Dec. 31, 1985

[51] Int. Cl.[4] ..... B32B 3/26; B32B 35/00

[52] U.S. Cl. ..... 428/63; 52/514; 156/94; 156/98; 156/252; 156/293; 264/36; 404/75; 404/82; 427/140; 428/139

[58] Field of Search ..... 52/514; 156/94, 98, 156/252, 293; 264/36; 404/75, 82; 427/140; 428/63, 139

[56] References Cited

U.S. PATENT DOCUMENTS

| | | | |
|---|---|---|---|
| Re. 20,607 | 12/1937 | Tomec | 428/139 |
| 505,699 | 9/1893 | Bull . | |
| 2,721,369 | 10/1955 | Burke | 404/82 X |
| 3,557,671 | 1/1971 | Vasiloff | 404/82 |
| 3,986,885 | 10/1976 | Lankard | 106/99 |
| 4,339,289 | 7/1982 | Lankard | 156/91 |
| 4,366,255 | 12/1982 | Lankard | 501/95 |
| 4,392,335 | 7/1983 | Heiman | 52/514 X |
| 4,398,842 | 8/1983 | Hodson | 404/82 |
| 4,513,040 | 4/1985 | Lankard | 428/49 |

FOREIGN PATENT DOCUMENTS 2371549 6/1978 France .

*Primary Examiner*—Robert A. Dawson

*Attorney, Agent, or Firm*—Biebel, French & Nauman

[57] ABSTRACT

A procedure for providing an overlay on a concrete slab or similar subsurface including the steps of placing a plurality of anchor holes into the concrete slab to be repaired and/or providing an anchor channel at its periphery, providing a bed of fibers on the exposed surface of said concrete slab and extending into and filling said anchor holes and/or channel, infiltrating a flowable cement slurry throughout the fibers and into the anchor holes and/or anchor channel, and curing the slurry to form an overlay which has integral fiber-reinforced anchor portions extending into the slab.

19 Claims, 6 Drawing Figures

INTEGRALLY-ANCHORED FIBER-REINFORCED CONCRETE OVERLAYS AND SURFACINGS AND METHOD OF MAKING SAME

BACKGROUND OF THE INVENTION

The present invention relates to an integrally anchored fiber-reinforced concrete overlay and to a method of making the same.

A commonly used procedure for restoring the original riding quality of highway and airfield pavements is to overlay the existing deteriorated roadway with a new layer of construction material such as asphaltic concrete or Portland cement concrete. Typically, the overlay procedure involves extensive preparation of the existing pavement in the form of removal of deteriorated pavement material, scarification of the existing wearing surface, and application of a bonding layer to tie the new overlay firmly into the existing pavement. The conduct of these steps is both time consuming and costly.

Even when the old pavement has been properly prepared, it is not uncommon for the bond between the new overlay and the old pavement to exhibit disruption. This event frequently is followed by the onset of cracking and spalling distress in the overlay material. The problems in bonding of overlay materials to existing pavements has limited the use of this pavement restoration option.

There are situations in which, because of the severity of traffic conditions, overlays cannot be considered since it is very certain that they will not function satisfactorily for a sufficient period of time. The only acceptable alternative in many of these cases is to fully excavate the old pavement and completely replace it with a new pavement.

The most commonly used overlay material for restoring deteriorated highway pavements is asphaltic concrete. It is generally recognized that while the material can be conveniently and expeditiously placed, its performance record leaves much to be desired. Additionally, because of the great weight of modern-day aircraft, asphaltic concrete is typically not the material of choice for the overlay of airfield pavements. Thus, in the restoration of airfield pavements, restoration alternatives frequently come down to complete replacement or the use of relatively thick sections of conventional Portland cement concrete.

In addition to the overlay restoration of existing, deteriorated pavements, there are other construction situations in which a fully bonded overlay or surfacing material could be a cost-effective restoration procedure. Examples include hydraulic structure applications (stilling basins, fliplips, spillways), open culverts, bridge decks, and industrial floors.

U.S. Pat. No. 4,339,289, entitled Concrete Overlay Construction, issued July 13, 1982 to the inventor of the present invention and incorporated herein by reference, describes a fiber-reinforced overlay incorporating 4 to 12% by volume steel fibers. However, in the preparation of the overlay, the overlay material is bonded to the substrate paving material through the use of bonding agents such as a Portland cement slurry or an epoxy adhesive. These bonding agent materials have been, and are, currently used in an effort to provide a durable bond between overlay materials and pavements. Not infrequently, despite the use of these bonding agents, disruption does occur between the overlay material (whatever its composition) and the substrate pavement.

Thus, an overlay and surfacing material is needed having good resistance to cracking, spalling, wear, and other forms of distress and which remains fully bonded to the substrate on which it has been placed. The integrally anchored steel fiber-reinforced concrete overlay and surfacing material of the present invention meets these qualifications, the combination of which is not currently available in a single-materials system.

SUMMARY OF THE INVENTION

The present invention relates to a novel procedure and structure for bonding or anchoring the fiberreinforced concrete overlay of U.S. Pat. No. 4,339,289 to any existing substrate in need of restoration, including highway and airfield pavements, dam spillways, and the like and certain refractory elements such as kiln car tops. The new overlay/surfacing minimizes the efforts involved in preparing the substrate for the overlay, assures excellent initial and continued bonding of the overlay to the substrate, and provides a wearing surface that is more resistant to cracking, spalling, and other forms of distress than any currently available construction material.

The present invention may be described as an integrally anchored fiber-reinforced concrete overlay and surfacing material. Using the novel design and method of the present invention, integral anchors tie the overlay into the substrate. An example of how this is accomplished is presented below based upon the restoration of a concrete bridge deck.

Currently, extensive preparation of an existing bridge deck wearing surface is required before the placement of an overlay. This preparation involves (1) complete replacement of all delaminated and deteriorated concrete (sometimes involving the full depth of the bridge deck), (2) scarification of the entire bridge deck wearing surface to a depth of $\frac{1}{4}$ inch or so, (3) sandblasting of the scarified wearing surface, (4) cleaning of the sandblasted wearing surface, and (5) application of a primer material or bonding agent just prior to the placement of the overlay material.

With the overlay system of the present invention, it is possible that all of the preparation steps just mentioned could be eliminated. The only preliminary step required for the overlay system of the present invention is the drilling of anchor holes in the surface of the bridge deck.

It is accordingly an important object of this invention to provide a structure and method for restoring pavements, spillways, curbings or the like in which integral reinforced anchors are formed as a part of an overlay and extend therefrom into the structure to be reinforced and restored, such as through anchor holes, to form and define integral footers or anchors for the super structure.

A further object of the invention is the provision of a method of restoring existing pavements, roadways, and the like by forming a plurality of anchor holes into the existing surface and/or forming an anchor channel at the periphery of the surface, filling such anchor holes and/or such channel with reinforcing fibers, followed by the infiltration therethrough of a cement-based slurry composition.

A further object of the invention is the provision of a reinforced pavement, roadway or the like, having integral steel fiber filled support and anchoring members.

These and other objects and advantages of the invention will be apparent from the following description, the accompanying drawings and the appended claims.

DESCRIPTION OF THE PREFERRED EMBODIMENTS

Figure 1:
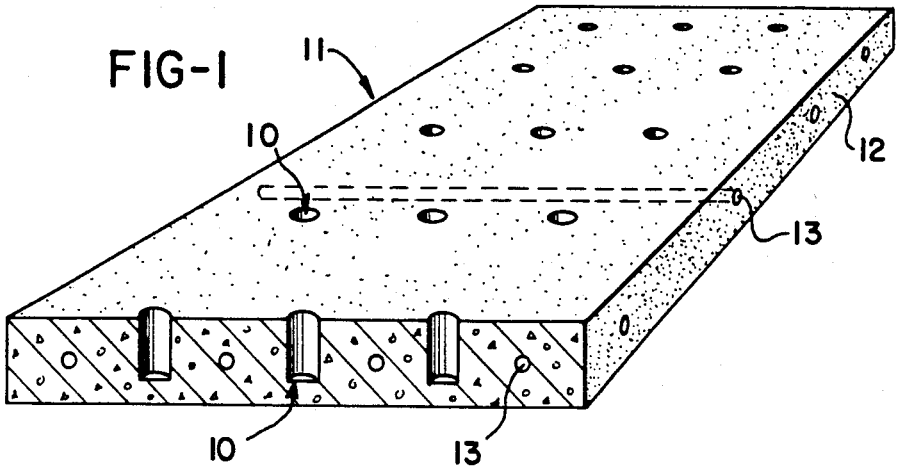
FIG. 1 is a perspective view of a bridge deck which has been prepared for resurfacing in accordance with this invention.

In the example shown in FIG. 1, a bridge deck is illustrated as typical, but it should be understood that the invention may be applied to either Portland cement-based or asphaltic concrete surfaces which may comprise, for example, runways, roadways, bridges, culverts, or the like. However, the invention is particularly applicable to repairing and reinforcing wear surfaces of such concrete slabs.

As illustrated in FIG. 1, a pattern defining a plurality of spaced-apart anchor holes 10 extend from the upper surface 11 of a concrete bridge slab 12 having reinforcing rods 13 therein. The diameter, number and spacing of anchor holes 10 are selected so as to provide a substructure which supports and anchors the overlay to the underlying structure.

In many applications, the anchor holes are 4.0 inches in diameter, spaced on 10 foot centers, and approximately 90% of the total depth of the substrate. If it is more convenient to do so, the anchor holes can be drilled through the entire slab thickness, however, this makes it necessary to plug the holes later to support the fibers during their placement and infiltration.

The anchor holes can also be placed at a slight angle to further improve the mechanical bond. The anchor holes can be of any suitable cross-section although they are most typically circular. The anchor holes must be wider than the fibers are long. Typically they are at least twice the fiber length. The anchor holes can be formed by drilling or by cutting into the concrete surface.

Figure 2:
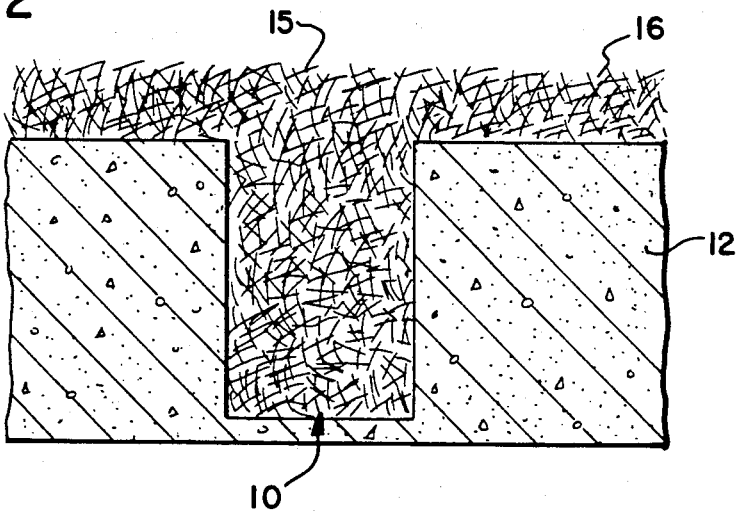
FIG. 2 is a cross-sectional view of the bridge deck as shown in FIG. 1 and further illustrating the layer of steel fibers applied to the anchor holes and over the surface of the deck defining an overlay thickness on the deck surface and forming an integral reinforcing unit at the anchor hole.

Following placement of the anchor holes, they are filled with fibers 15 as shown in FIG. 2. The fiber placement step is not limited to filling of the anchor holes. Rather, the placement of fibers is continued in such a manner that a finite layer or bed of fibers covers the entire substrate area as illustrated at 16 in FIG. 2. In this manner an interlocking fiber network is provided which extends from the anchor holes 10 into the bed 16. The thickness of the fiber layer or bed 16 built up on the deck or substrate can be any that is desired. However, for most overlay and surfacing applications, it is expected that this thickness will typically be about 0.5 inch to 4.0 inches.

The fibers 15 may be of the kind disclosed and described in U.S. Pat. No. 4,339,289. The fibers are preferably packed so as to yield an anchor and overlay which comprises between at least 4% and up to 12% or more of the volume. Metal (preferably steel) fibers are preferred although glass fibers, carbon fibers and ceramic fibers can also be used.

The fibers may have a diameter or width area of from about 0.006 up to 0.063 inch with average lengths of from 30 to 250 times the diameter. A preferred fiber diameter is from about 0.010 to 0.040 inch, with an aspect ratio greater than 50. Longer fibers can be utilized since the mixing of the fibers in the concrete mix is not required.

Once the desired thickness of the steel fiber layer on the substrate is achieved, steps are taken to assure that the top surface of the fiber layer conforms to a previously established grade and levelness requirement. For example, the fiber layer may be compacted or leveled by rolling the bed with an appropriate roller means. This insures that extraneous fibers are not extending from the surface of the overlay.

In accordance with a preferred embodiment of the invention, after leveling the fiber bed, the surface of the fiber bed is sprayed with a latex adhesive. The function of the latex is to bind the fiber matrix so that it retains its integrity as it is subsequently infiltrated with the cement slurry.

Figure 3:
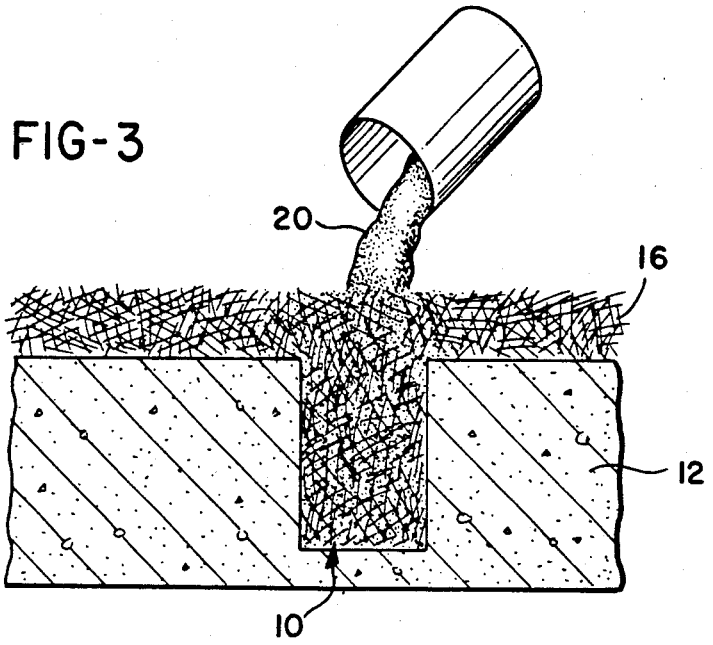
FIG. 3 is a view similar to FIG. 2 and showing the cement-based slurry infiltration throughout the layer of steel fibers and the anchor hole.

Following installation of the fiber bed 16, the bed is infiltrated with a cement based slurry 20 as shown in FIG. 3. Typically, the slurry will be water-based and will contain a hydraulic cement such as Portland cement as the principal bonding agent. The slurry may contain fly ash and a plasticizer as described in U.S. Pat. No. 4,339,289. However, any slurry composition in liquid form is potentially useful and cements other than Portland cement including refractory cements can be used depending upon the application of the overlay. The slurry may or may not contain a fine aggregate phase such as silica sand.

A satisfactory Portland cement-based slurry 20 may consist of 70% by weight Portland cement, 30% fly ash, 30% water based on the dry batch weight, and 9 ml per pound of dry batch of a superplasticizer, tradename "Mighty 150" of Borden and Remington, Falls River, Maine.

More or less water may be employed to adjust the viscosity so that the slurry will flow through the fiber layer without substantial vibration, so that the slurry 20 moves through the packed fiber bed primarily by force of gravity. However, external vibration may be applied to assist the same in filling the bed and the anchor holes. The slurry fills all of the open spaces between the packed fibers 15 in the drilled anchor holes and on the substrate surface.

Figure 4:
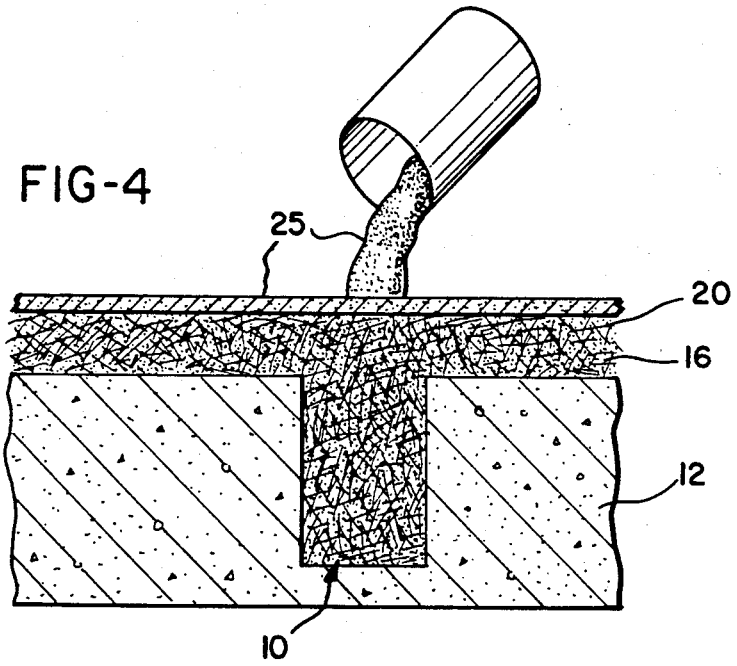
FIG. 4 is a view of the section of FIG. 3 and illustrating the addition of a coarse aggregatecontaining wearing surface over the integrally anchored steel fiber-reinforced concrete overlay.

The steps required beyond the infiltration step depend upon the type of wearing surface desired. For a bridge deck overlay, it is likely that the immediate wearing surface of the overlay will need to incorporate some form of aggregate material. Such a construction is illustrated in FIG. 4 which shows a section view of a steel fiber-reinforced concrete overlay in which the top layer 25 may be 0.5 inch thick (i.e., the wearing surface). The overlay is formed from a wear-resistant concrete such as one which contains cement, sand and ⅜ inch maximum size limestone coarse aggregate in addition to other ingredients of the infiltrating slurry (i.e., water, Portland cement, and fly ash).

Other overlay/surfacing applications such as dam spillway surfacings and open culvert surfacings, may not require the use of additional aggregate materials in the immediate wearing surface of the overlay/surfacing. In these cases, the infiltrating slurry itself will form the exposed overlay/surfacing surface.

Through the use of formwork, overlays/surfacings of the type just described can be placed on vertical and sloped substrate surfaces. A procedure for achieving this end is shown in FIG. 5.

Figure 5:
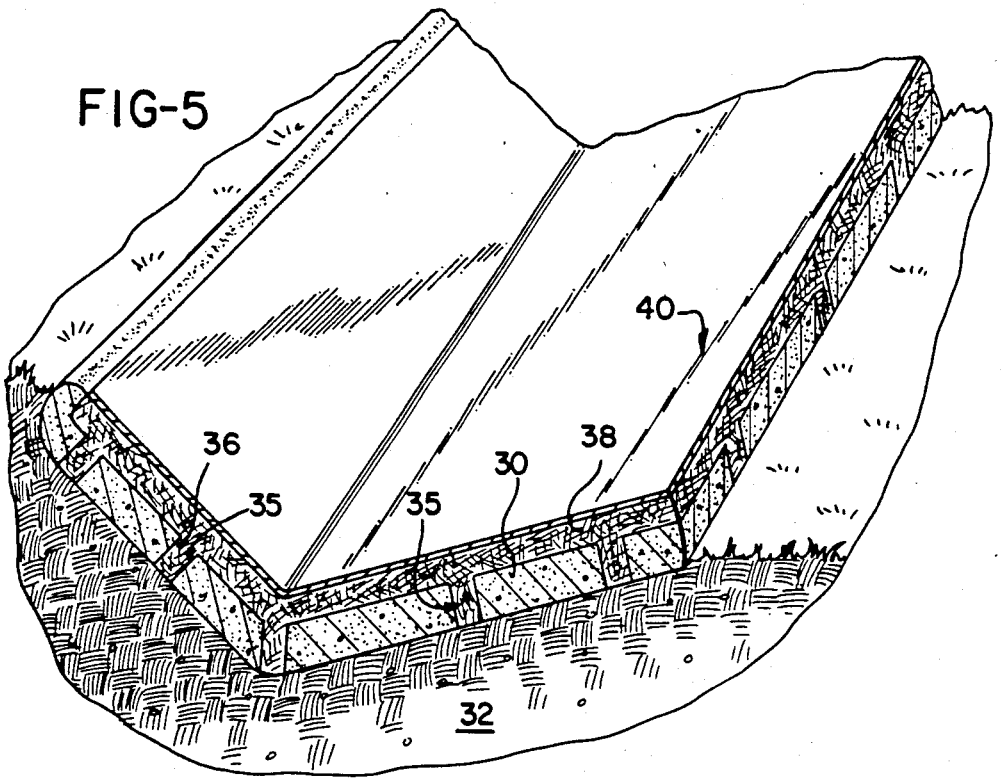
FIG. 5 is a fragmentary view of a concrete culvert which is reinforced in accordance with this invention.

In FIG. 5, the reinforced concrete culvert 30 has a generally V-or U-shaped configuration extending along sloped surfaces of a subsoil support 32. A plurality of anchor holes 35 are drilled through the culvert 30 in a pattern in spaced relation as described above in connection with the holes 10 of FIG. 1. The anchor holes 35 may be 4.0 inches in diameter and provide recesses for integral anchors filled with fibers in the manner previously described. Further, an overlay layer of the fibers as shown by the layer 38 may be applied to the inside surface of the culvert 30 and retained in place by a suitable form 40, which form may be made of wood, plastic, metal or fabric, to retain the fiber layer 38. Thereafter, an infiltrating slurry as previously described is applied to the layer and permitted to fill the anchor holes 35 and infiltrate the fibers therein. Infiltration may be assisted by vibration, as previously described. After construction, the form 40 is removed.

Figure 6:
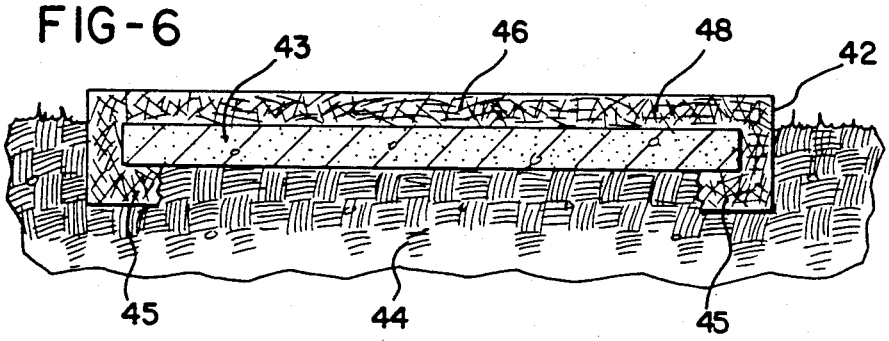
FIG. 6 is a vertical section illustrating a concrete slab overlay formed with an integral anchoring channel in accordance with another embodiment of the present invention.

FIG. 6 illustrates a further embodiment of the invention in which the overlay is secured to a concrete slab using an anchor channel instead of the anchor holes shown in FIGS. 1–5. A channel 42 is formed between the slab member 43 and the soil 44. The channel includes portions 45 which extend under the slab 43. The channel is filled with fibers and infiltrated with a cement slurry analogous to the manner described above. The inwardly extending portions 45 of the channel in conjunction with the fiber network 48 function to integrally anchor the overlay 42 to the surface of the slab. Anchor holes may be used in conjunction with the anchor channel if desired.

The method of the present invention can also be used to resurface refractory elements such as kiln car tops. In this embodiment, anchor holes are provided in the refractory element in an analogous manner to FIG. 1. In this case, the anchor holes and the fiber layer are infiltrated with a refractory concrete containing a fine refractory aggregrate. Useful refractory concretes are described in U.S. Pat. No. 4,366,255.

It is accordingly seen that this invention provides a procedure for reinforcing and resurfacing concrete slabs which may be horizontal or on a slope by employing integral units of fiber-reinforced concrete which extend through or into anchor holes formed in the slab.

While the process and product herein described constitute preferred embodiments of this invention, it is to be understood that the invention is not limited to this precise process and product, and that changes may be made therein without departing from the scope of the invention which is defined in the appended claims.

What is claimed is:

1. The method of overlaying a reinforced concrete layer on a supporting subsurface, comprising the steps of:

forming a plurality of anchor holes in a supporting substrate and/or a channel at the periphery of said supporting substrate, said anchor holes extending from the exposed surface of said supporting substrate substantially through the thickness thereof and said anchor channel having a depth greater than the thickness of said supporting substrate and extending inwardly of said supporting substrate at its base;

providing a bed of reinforcing fibers on said exposed surface of said supporting substrate and extending into and filling said anchor holes and/or said anchor channel; and infiltrating a flowable cement based slurry into said bed of reinforcing fibers and said anchor holes and/or said anchor channel to provide, after curing, an integral overlay of fiber-reinforced cement based composition on said supporting substrate and extending into said anchor holes and/or said anchor channel.

2. The method of claim 1 wherein said supporting substrate is a concrete slab.

3. The method of claim 2 wherein a plurality of anchor holes are formed in said slab.

4. The method of claim 2 comprising the further step of adding a surface layer of concrete over said overlay to form a wearing surface.

5. The method of claim 4 wherein said reinforcing fibers are steel fibers.

6. The method of claim 2 wherein an anchor channel is formed at the periphery of said slab.

7. The method of repairing and reinforcing a roadway surface such as that of a road, bridge or runway slab or the like, comprising the steps of:

providing in the roadway to be repaired a pattern of spaced-apart anchor holes from the upper surface thereof and extending into the thickness thereof or providing an anchor channel at the periphery of said roadway;

providing a layer of reinforcing fibers on the surface of said roadway and extending into and filling said anchor holes and/or said anchor channel;

infiltrating said layer and said anchor holes and/or said anchor channel with a slurry of flowable concrete mixture so that the interstices between the reinforcing fibers are filled by said mixture; and allowing said mixture to cure.

8. The method of claim 7 wherein said reinforcing fibers are steel fibers.

9. The method of claim 8 in which anchor holes are formed in said roadway.

10. The method of claim 8 wherein an anchor channel is formed at the periphery of said roadway.

11. The method of claim 7 comprising the further step of superimposing a wear aggregate layer over said infiltrated and cured layer.

12. The roadway reinforced according to the method of claim 7.

13. The method of claim 1 comprising the additional step of applying an adhesive to the exposed surface of said bed of reinforcing fibers prior to infiltrating said fibers with said cement-based slurry, said adhesive maintaining the integrity of said bed as said fibers are infiltrated with said slurry.

14. The method of claim 7 comprising the additional step of applying an adhesive to the exposed surface of said bed of reinforcing fibers prior to infiltrating said fibers with said cement-based slurry, said adhesive maintaining the integrity of said layer as said fibers are infiltrated with said slurry.

15. The method of claim 1 wherein said method consists essentially of said steps of forming said anchor holes or said anchor channel, providing said bed of reinforcing fibers, and infiltrating said flowable cement slurry into said fiber bed, said method being a method for overlaying a reinforced concrete layer on a supporting subsurface without the use of bonding agents.

16. The method of claim 7 wherein said method consists essentially of said steps of providing said anchor holes and/or said channel, providing said layer of reinforcing fibers extending into and filling said anchor holes and/or said channel, infiltrating said fiber layer with said slurry of said concrete mixture, and allowing said mixture to cure.

17. A reinforced and resurfaced concrete slab comprising an upper layer of cured flowable Portland cement based mixture reinforced by a plurality of fibers extending throughout said layer and over said slab, and a plurality of integral units of said metal fiber reinforced mixture extending from said layer into or at the periphery of said slab, said units forming anchors for securing said layer on said slab.

18. The concrete slab of claim 17 wherein said reinforcing fibers are steel fibers.

19. The concrete slab of claim 17 consisting essentially of said upper layer of cured Portland cement reinforced by said fibers and said plurality of integral units of said metal fiber reinforced mixture.

* * * * *